United States Patent [19]

Panepinto

[11] 4,226,412

[45] Oct. 7, 1980

[54] HAND EXERCISER

[75] Inventor: Louis Panepinto, Hillsdale, N.J.

[73] Assignee: AMF Incorporated, White Plains, N.Y.

[21] Appl. No.: 833,833

[22] Filed: Sep. 16, 1977

[51] Int. Cl.[3] ..... A63B 21/30

[52] U.S. Cl. ..... 272/68; 272/142

[58] Field of Search ..... 272/68, 67, 137, 142, 272/143, 135, 136

[56] References Cited

U.S. PATENT DOCUMENTS

| | | | |
|---|---|---|---|
| 689,652 | 12/1901 | Perry | 272/68 |
| 938,348 | 10/1909 | Stull | 272/68 |
| 1,620,910 | 3/1927 | Minnich | 272/68 X |
| 1,623,670 | 4/1927 | Frankenfield | 272/68 UX |
| 1,877,218 | 9/1932 | Blank | 272/137 |
| 3,570,849 | 3/1971 | Ratchford | 272/68 |

*Primary Examiner*—Richard C. Pinkham
*Assistant Examiner*—William R. Browne
*Attorney, Agent, or Firm*—George W. Price; Walter Lewis

[57] ABSTRACT

A long slotted sleeve holds the two U-shaped members together and serves dual function of a guide and stop. Tension springs extend between the two cross portions of the U-shaped members to provide resistance.

2 Claims, 3 Drawing Figures

HAND EXERCISER

This invention relates to an improved hand exerciser and more particularly to an improved squeeze and spring type hand grip exerciser.

On one prior art form of the above-mentioned type exerciser, a short U-shaped member positioned within a longer U-shaped member is movably tied thereto by a short sleeve about the facing legs thereof, and a separate stop lug is positioned on the longer U-shaped member below the other U-shaped member. This type of arrangement has been found to be prone to binding or jambing due to cocking of the parts.

It is an object of this invention to provide an improved hand exerciser which will overcome the shortcomings of the prior art and provide other advantages as well, such as a reduction in parts and/or manufacturing steps.

Briefly, in my improved hand exerciser a slotted long sleeve is used in place of the short sleeve and stop lug of the prior art and performs the two functions of the last two mentioned parts, but in a better manner. That is to say, the long sleeve is a better guide for sliding movement of the parts with respect to each other so that binding or jambing due to cocking or the like is avoided.

In the attached single sheet of drawing.

Figure 1:
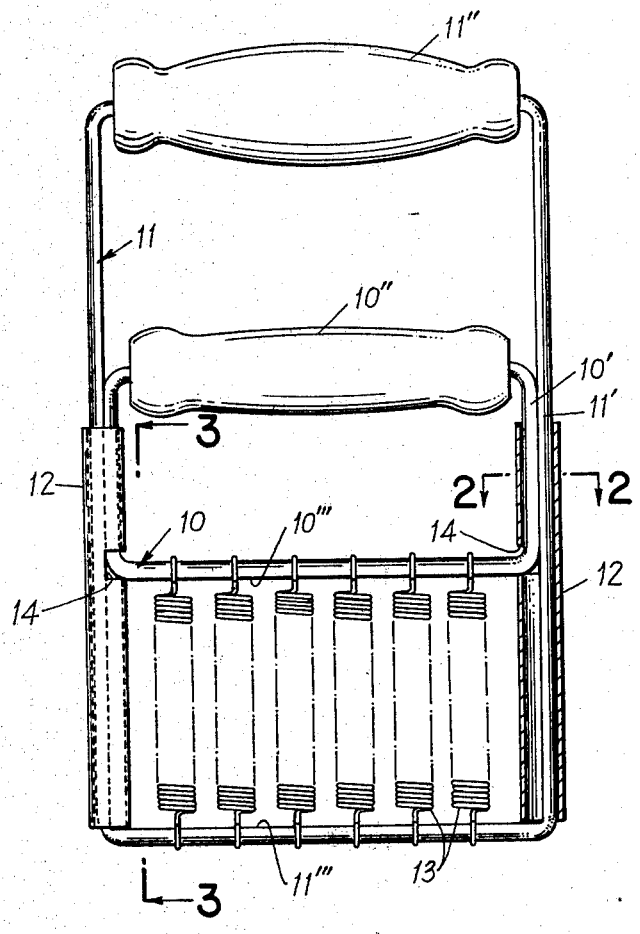
FIG. 1 is an elevation view of one form of my invention.
Figure 2:
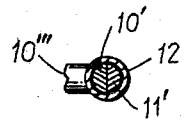
FIG. 2 is a sectional view taken along section line 2—2 of FIG. 1; and, FIG. 3 is a sectional view taken along the section line 3—3 of FIG. 1.
Figure 3:
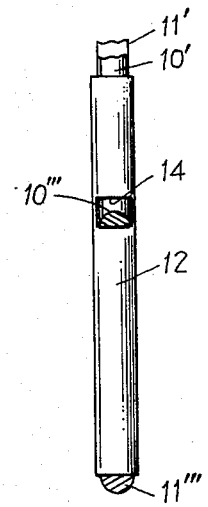

Referring now to all three Figs. of the drawing in connection with the following specific description, the improved hand exerciser comprises a short U-shaped member 10 within a longer U-shaped member 11. Member 10 slides within member 11. Members 10 and 11 are held captive with respect to each other by a sleeve 12 which surrounds their contiguous leg portions 10' and 11', see FIG. 2. The cross-sectional shape of parts 10 and 11 is semi-circular, and at their legs 10' and 11' their flat surfaces face and slide along each other.

The upper ends of the U-shaped members 10 and 11 enter the opposite ends of hollow or end-drilled hand grip handles 10'' and 11'' respectively. The bite portions 10''' and 11''' are spaced with respect to each other and are spanned by one or more tension springs 13. Opposite ends of the springs 13 are readily hooked on the spaced bites 10''' and 11''' so that the amount of force that has to be applied to the two grips 10'' and 11'' to move them towards each other is easily adjusted. In use of the device the user's hand grips both handles 10'' and 11'', the handle 11'' being positioned between the user's palm and thumb, and the ends of the four fingers of the hand extending about the grip 10''.

In the invention the sleeve is made long enough to extend for about the total length of legs 10' and that portion of legs 11' below legs 10'. In addition at the bite 10''' the sleeves have a semi-circular inside slot 14 adjacent to the generally right-angle shaped bottom corners of the member 10. Thus, a long guide is provided for sliding the legs 10' and 11' with respect to each other so that there is no sticking, binding, jambing, or cocking of these parts with respect to each other when moved so as to tension the springs or in their return movement. When grip 10' is squeezed towards grip 11'', the upper edges of the slots 14 bottom on the bite 10''' so that the whole slide guide sleeve 12 moves therewith. On return movement or release of the grip 10'' the bite 10''' bottoms on the lower edges of slots so that the sleeve again moves therewith. When the lower ends of sleeves 12 bottom on the bite 11''', return movement is arrested. Thus the sleeves 12, besides serving as a guide for sliding movement of the parts with respect to each other, also operates as a stop for the parts.

I claim:

1. In a hand grip exerciser comprising a pair of parallel hand grips, and a pair of generally U-shaped members connected to the girps, one of the U-shaped members being shorter than and positioned within the other, and resilient means spanning the spaced bite portions of said U-shaped members; the improvement of a long sleeve surrounding both legs of said U-shaped members for about the total length of the legs of the shorter of said U-shaped members and in addition surrounding about the total length of that portion of the legs of the longer of the two members positioned between said spaced bite portions, and a slot in each of said sleeves at the juncture of the legs and bite of said shorter member.

2. In an exerciser, as in claim 1, wherein the legs of said U-shaped members have semi-circular cross-sections with their flat surfaces facing each other, said sleeves being circular in cross-section and holding said members captive with respect to each other, the total length of said sleeves being movable along the legs of the longer of the U-shaped members when the hand grip of the shorter U-shaped member is hand squeezed towards the other hand grip, said resilient means comprising tension springs, and said sleeves also being movable with return movement of said shorter member upon release of its hand grip until they bottom on the bite portion of the longer of the two members whereby said sleeves operate as a guide and stop for the two members.

* * * * *